US005527208A

United States Patent [19]

Blake et al.

[11] Patent Number: 5,527,208

[45] Date of Patent: Jun. 18, 1996

[54] FIXTURE FOR HOLDING AND ALIGNING A BLADE OF A HAND TOOL

[75] Inventors: John B. Blake, Park Ridge; Edgar H. Vanderbeck, Jr., Montvale, both of N.J.

[73] Assignee: Parkwood Products Co. Inc., Montvale, N.J.

[21] Appl. No.: 245,611

[22] Filed: May 19, 1994

[51] Int. Cl.[6] ..... B24B 19/00

[52] U.S. Cl. ..... 451/367; 451/377; 269/55

[58] Field of Search ..... 451/365, 366, 451/367, 377, 378, 380, 386, 389, 391, 392, 393, 405; 269/55, 56, 58

[56] References Cited

U.S. PATENT DOCUMENTS

| | | | |
|---|---|---|---|
| 1,951,554 | 3/1934 | Martin | 451/377 |
| 2,887,833 | 5/1959 | Passarotti | 451/367 |
| 3,127,717 | 4/1964 | Sommers | 451/367 |
| 3,181,283 | 5/1965 | Tuttle | 451/377 |
| 3,574,268 | 4/1971 | Buse | 451/367 |
| 3,733,751 | 5/1973 | Williams | 451/377 |
| 4,961,287 | 10/1990 | Compton | 451/367 |
| 5,218,787 | 6/1993 | Rice | 451/392 |

*Primary Examiner*—Maurina T. Rachuba
*Attorney, Agent, or Firm*—Patrick J. Pinto

[57] ABSTRACT

A fixture for holding and aligning a blade of a hand tool during sharpening with a sharpening apparatus which includes a base member and a clamping plate. The base member includes a front side, rear side, a clamping surface, a bottom surface and a guiding means. The guiding means is selectively positioned along the bottom surface between the front side and rear side. The base member further includes an aligning means which projects above the clamping surface for positioning the blade at a predetermined angle with respect to an axis of the guiding means. The clamping plate is removably attached to the base member by a pair of clamping means. The guiding means is configured for easy removal and seating in an elongated mating recess in a support plate attached to the sharpening apparatus. The guiding means allows fully guided pivotal and linear movement of the blade with respect to an abrasive surface of the sharpening apparatus.

19 Claims, 2 Drawing Sheets

FIG. 1
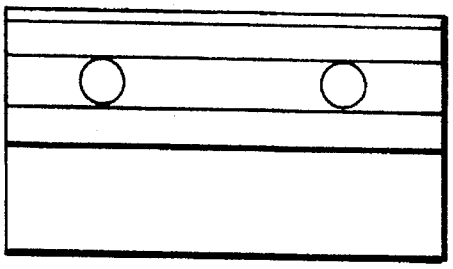
FIG. 2
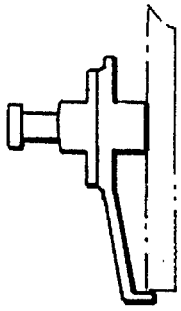
PRIOR ART
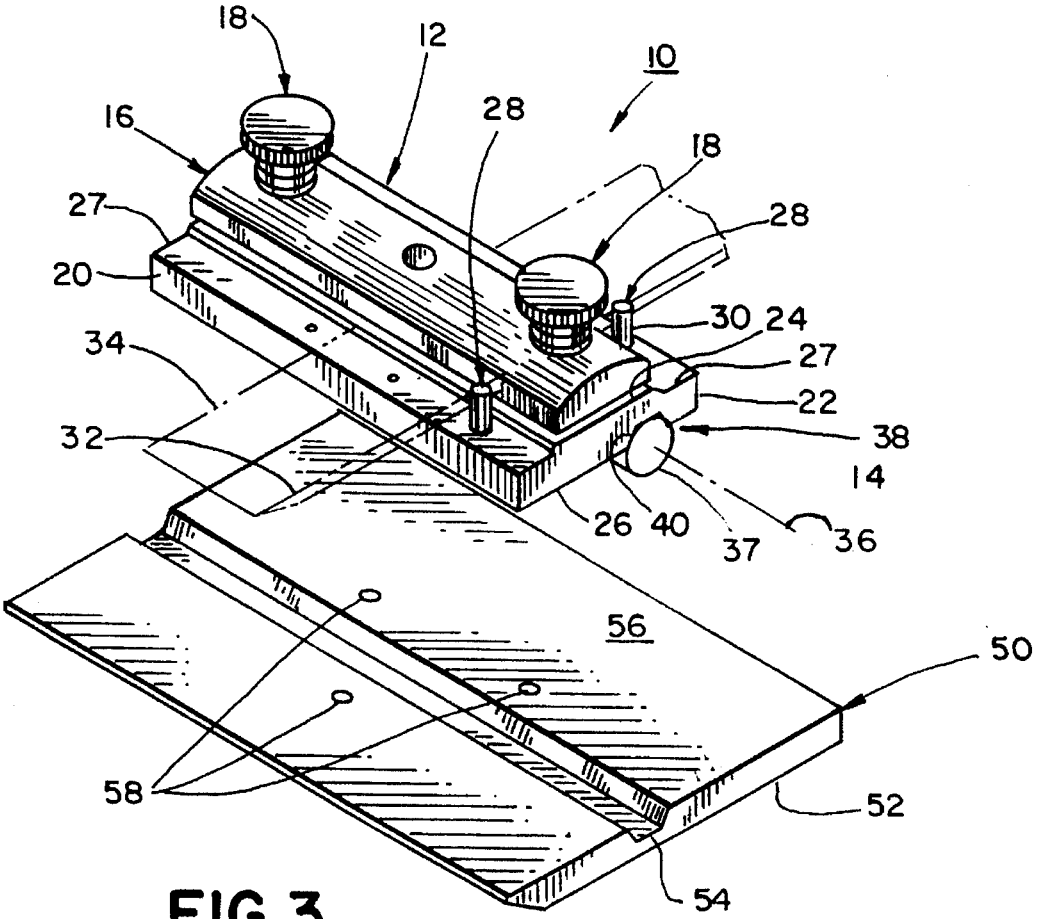
FIG. 3

FIXTURE FOR HOLDING AND ALIGNING A BLADE OF A HAND TOOL

BACKGROUND OF THE INVENTION

FIELD OF THE INVENTION

With regard to the classification of art, this invention is believed to be found in the general class entitled "Abraiding", and more particularly to the subclasses pertaining to "Accessories", and to those accessories used as a fixture for sharpening of a blade.

DESCRIPTION OF THE PRIOR ART

In the field of woodworking, it is necessary to use hand tools such as chisels, hand planes and the like. In order to maintain peak performance, it is necessary to frequently sharpen the cutting edge of these hand tools. In earlier times sharpening was accomplished by using hand or foot powered grinding wheels. This process required much skill and was slow.

Presently most woodworkers use electrically powered grinding wheels. The use of electrically powered grinding wheels has not made the task of sharpening much easier. Since most of the electrically operated grinding wheels rotate at a high RPM, the woodworker must be careful not to burn the cutting edge of the tool. If burning of the tool occurs, the blade loses its hardness.

Recently some grinding apparatus have been used which employ a combination of low rotating speed and lubrication of the grinding surface of the wheel to eliminate the burning of the tool.

Most woodworkers including hobbyist find that it is impractical to send the tools to a sharpening service, because of time constraints.

In order to provide the woodworker with the convenience of having sharpened tools, which are available as needed, a fixture for holding the blade of the tool has been commercially available. This commercially available fixture is shown in the drawing as FIG. 1 and FIG. 2 and labeled "PRIOR ART". Usually a flange of the fixture is guided by an edge of a support plate, shown in dashed outline.

While the use of this prior art fixture has helped the woodworker, there is a need for improvements. One of these improvements include positive correct alignment of the cutting edge of the tool with the grinding wheel. A second improvement includes allowing the woodworker to easily inspect the condition of the sharpened edge. A third improvement includes the ability of the woodworker to return the fixture to substantially the same position with respect to the grinding wheel. A fourth improvement includes providing surfaces on the fixture which act as bearing surfaces. These bearing surfaces prevent wear to the grinding wheel apparatus as well as to the fixture. If damage occurs to the prior art fixture, it may have to be discarded.

The present invention solves the above identified needs and others benefits will become apparent by reading the following disclosure.

SUMMARY OF THE INVENTION

This invention may be summarized in part, with respect to its objects. It is an object of this invention to provide and it does provide a fixture for holding a blade of a hand tool which provides positive and repeatable alignment of the blade in the fixture.

It is another object of this invention to provide and it does provide a fixture for holding a blade of a hand tool which provides easy inspection of said sharpened surface while allowing a quick return of said fixture to a grinding position.

It is still another object of this invention to provide and it does provide a fixture for holding a blade of a hand tool wherein said fixture includes bearing surfaces which substantially eliminate wear to a supporting surface of a grinding apparatus.

It is yet another object of this invention to provide and it does provide a grinding fixture with a guiding means which includes a selectively shaped recess for compensating for manufacturing tolerances of guide rod material.

Briefly, one embodiment of the present invention may be described as follows. A fixture for holding and aligning a blade of a hand tool to be sharpened by a sharpening apparatus, the fixture comprising: a) a base member which includes a front side, a rear side, a clamping surface, a bottom surface, and a guiding means. The guiding means being selectively aligned, along said bottom surface, intermediate said front side and said rear side. The base member further includes an aligning means projecting at right angles with respect to a plane of said clamping surface. The aligning means being adapted for positioning a blade to be sharpened at right angles to an axis of said guiding means. (b) A clamping plate having a selected profile, said clamping plate being removably attached to said base member by at least two clamping means. Wherein said guiding means is configured for removable placement on a mating guiding track of a support plate of a sharpening apparatus, said guiding means adapted for allowing pivotal movement of said base member about said axis of said guiding means, said guiding means further allowing selective linear movement of said base member along a plane which is parallel to said axis.

In addition to the above summary, the following disclosure is detailed to insure adequacy and as an aid in the understanding of this invention. For this reason, there have been chosen specific embodiments of the present invention. These specific embodiments, chosen only for the purpose of illustration and description, are shown in the accompanying drawings.

BRIEF DESCRIPTION OF THE DRAWING

FIG. 1 labeled "PRIOR ART" represents a plan view of a known fixture.

FIG. 2 labeled "PRIOR ART" represents a right side elevational view of the fixture of FIG. 1.

FIG. 3 represents an isometric view of a first embodiment of a fixture of the present invention.

Figure 4:
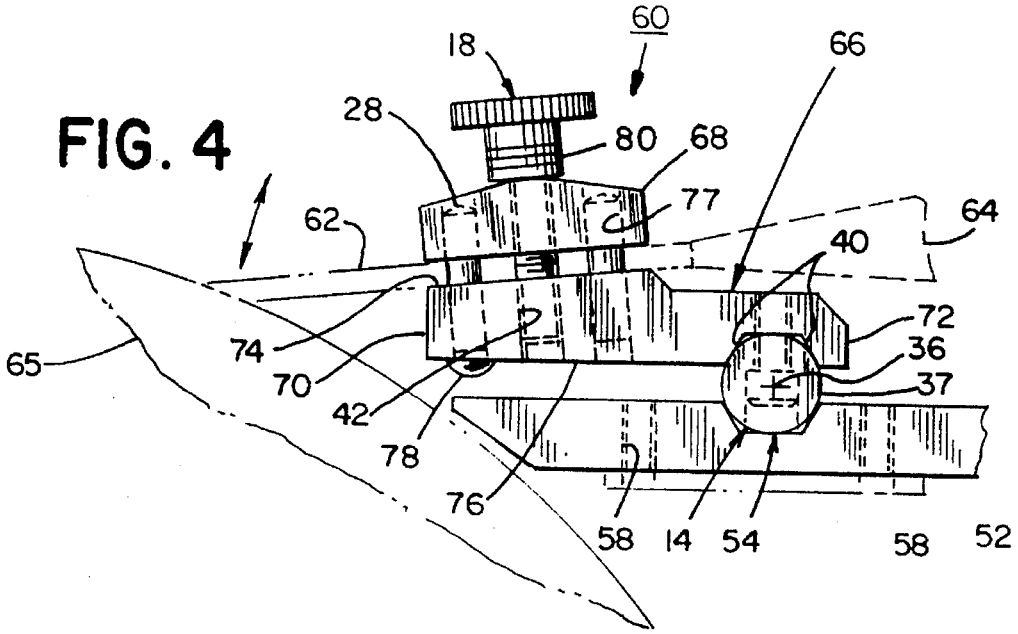
FIG. 4 represents a side elevational view of a second embodiment of the present invention.

In the following description and in the claims, various details of the invention are identified by specific names. These names have been chosen for convenience and are intended to be generic in their application while differentiating between the various details. The corresponding reference characters refer to like members throughout the several figures of the drawings.

The drawings accompanying, and forming a part of this disclosure show details of construction for the sole purpose of explanation. It is to be understood that structural details may be modified without departing from the concept and principles of the invention. This invention may be incorporated in other structural forms than shown.

DETAILED DESCRIPTION OF THE INVENTION

Referring first to FIG. 3, a fixture or jig assembly of the present invention is generally identified as 10. This fixture or jig assembly 10 includes a base member 12; a guiding means 14; a clamping plate 16, and clamping means 18.

The base member 12 is illustrated as having a substantially rectilinear shape. This base member 12 includes a front side 20; a rear side 22; a clamping surface 24; and a bottom surface 26.

The clamping surface 24 preferably is stepped a predetermined distance above a top portion 27 of the base member 12 adjacent the front side 20 and the rear side 22.

An aligning means 28 projects upwardly from a plane of the clamping surface 24. Preferably this aligning means 28 is a pair of hardened pins 30, such as dowel pins and the like. The distance that the aligning means 28 projects above the clamping surface is in the vicinity of 9.5 mm. (0.38 in.). One edge 32 of a blade 34, shown in dashed outline, is abutted in tangential relationship with both of the aligning means 28. It is preferred that the blade be positioned between a pair of the clamping means 18 to be properly clamped and secured for sharpening. The use of hardened pins is preferred because assembly and replacement of the pins is easily done. The hardness of the pins resists wearing of the aligning surfaces. The preferred material for the hardened pins is stainless steel. One benefit of using stainless steel is its resistance to corrosion. Other types of aligning means may include clip angles, molded projections, recessed grooves and the like.

The axis 36 of the guiding means 14 is positioned between the front side 20 and the rear side 22. The axis 36 is aligned at right angles to a plane defined by a tangentially abutting one edge 32 of the blade. It is preferred that the guiding means 14 includes an elongated circular rod 37 that rests in an elongated track or recess 38 in the bottom surface 26. The preferred recess 38 includes side walls 40 which slope at a predetermined angle with the bottom surface 26. An included angle of 60 degrees between the sloped sides has been found to give excellent results. The use of sloped side walls 40 insures that a guiding means 14 having a circular cross section will always be guided. The sloped side walls allow an elongated circular rod 37 with standard manufacturing tolerances to be seated in the recess 38 without excessive looseness or tightness. Of course, a recess with only one sloped side would also compensate for manufacturing tolerances. When the thickness of the base member allows, the recess 38 may be formed in the shape of a "V".

It is preferred that the elongated circular rod 37 be made of a bearing material to avoid damage to the recess 38 or a supporting plate assembly, generally identified as 50. The preferred bearing material should be of a plastic material. One example of such a material is Ultra High Molecular Weight Rod (UHMW). As previously mentioned, the sloped walls of the recess 38 allows stock material to be seated therein.

The circular rod 37 of the guiding means 14 is preferably secured in the recess 38 of the base member 12, as may be seen more clearly in FIG. 4. Other arrangements will be discussed below.

The clamping means 18 preferably includes a threaded fastener having an enlarged knurled head. The clamping means 18 is threaded into a mating threaded aperture 42 in the base member 12 to hold the clamping plate 16, seen more clearly in FIG. 4. It is preferred that the clamping plate 16 have clearance apertures therethrough which are sufficiently large for allowing blades with non-parallel faces to be securely clamped.

Referring again to FIG. 3, a support plate assembly 50 includes a rectilinear support plate 52. This support plate 52 preferably has an elongated track or recess 54 formed in its top surface 56. Preferably this recess 54 has substantially the same profile as recess 38. As previously mentioned this profile will properly seat stock materials within a predetermined range of sizes. The sloped sides also allow the guiding means 14 to pivot easily about its center or axis 36, with respect to the support plate assembly 50. The support plate assembly 50 includes a plurality of threaded apertures 58 for mounting to a sharpening apparatus.

Referring now to FIG. 4, an alternate embodiment for a fixture assembly of the present invention, is generally identified as 60. This alternate embodiment 60 is configured for clamping chisels and like tools which have a short blade 62 attached to a handle 64. The short blade 62 and handle 64 have been shown in dashed outline for ease of illustration. A portion of a rotary grinding wheel is identified as 65, and shown in dashed outline.

The alternate fixture assembly 60 includes a base member 66; a guiding means 14, a clamping plate 68; and a clamping means 18.

The base member 66 has front side 70; a rear side 72; a clamping surface 74; and a bottom surface 76. The clamping surface 74 is adjacent the front side 70 and is formed at a slope with respect to the bottom surface 76. The preferred slope is in the vicinity of 6 degrees. The preferred width of this sloped clamping surface 74 results in a stepped condition being formed with a top surface adjacent to the rear side 72. This stepped condition allows clearance for the handle 64 of the hand tool.

The placement of the aligning means 28 along the sloped clamping surface 74 of the alternate fixture assembly 60 requires that clearance apertures 77 be formed in the clamping plate 68. The clearance apertures for the clamping means 18 and the clearance apertures 77 should be sufficiently large to allow blades 62, which do not have parallel faces, to be accommodated.

Still referring to FIG. 4, a pair or plastic feet 78 are provided at a predetermined position on the bottom surface 26 These feet prevent accidental direct contact between the bottom surface 26 and the support plate 52.

In this second embodiment, the elongated circular guiding means 37 of the guiding means 14 is depicted as being secured to the fixture assembly 60. Alternatively, the guiding means could as well be secured to the support plate 52. Yet another possible arrangement for the guiding means, employs an elongated circular rod 37 which is placed into the elongated recess 54 absent a fastening means. The length of the guide means may be longer that the support plate for allowing movement of the fixture parallel to the axis of the grinding wheel. This parallel movement is illustrated by the arrows in FIG. 5.

Figure 6:
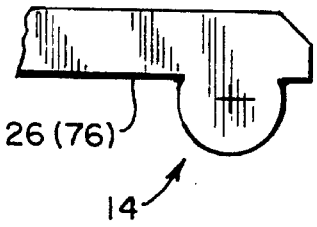
FIG. 6 represents a fragmentary side elevation of an alternate arrangement for a guide means.

Referring now to FIG. 6, another option for the guiding means 14 is a bulbous projection which is formed as an integral part of base members 12 and/or 66. The bulbous projection may have a plastic wear sleeve mounted thereon if the base member and the support plate are made of a metallic material. It is anticipated that the base member and/or the support plate assembly may be molded of a structural plastic material.

Figure 5:
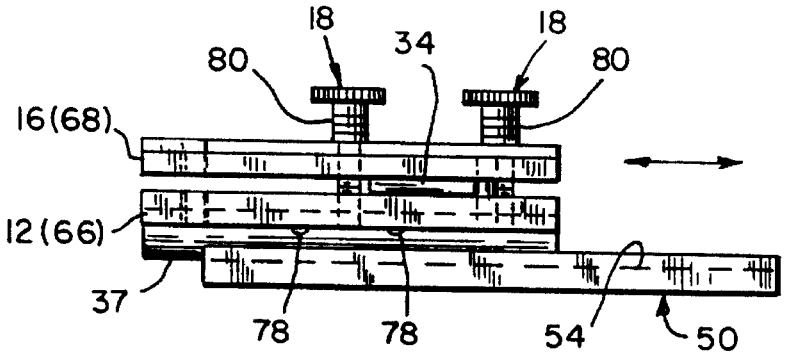
FIG. 5 represents a front elevational view of the present invention, this view being partly schematic and in a reduced scale.

Referring now to FIGS. 3; 4; and 5, a woodworker places a blade of a tool on the clamping surface 24 or 74, so that one edge 32 of the blade abuts both of the aligning means 28. The blade 34, with its tip to be sharpened projecting a desired distance, is clamped between the clamping surface and the clamping plate by tightening the clamping means 18. The fixture assemblies 10 or 60 guided by the guiding means 14 may be pivotally or radially moved in the direction of the arrow, seen in FIG. 4 or transversely moved in the direction of the arrow, as shown in FIG. 5. The wood worker may inspect the sharpened tip at any time by just lifting the fixture assembly 10 or 60 from the support plate. If more sharpening is needed, the fixture assembly 10 or 60 may be positioned on the support plate assembly 50 in substantially the exact position from which it was removed. It can be seen that the illustrated guiding means provides controlled movement of the fixture in at least two directions.

It is preferred that the clamping means be of a threaded fastener type, similar to a thumb screw. The use of a thumb screw allows the clamping means 18 to be moved to a center aperture in the clamping plate, as seen in FIG. 5. When a thumb screw is used, it may be necessary to provide spacers 80, seen in FIG. 3; 4; and 5, for preventing the end of the threaded portion of the clamping means 18 from projecting through the bottom surface of the fixture assembly 10 or 60 and hitting the support plate assembly 50. It is anticipated that other clamping means combinations may be used such as studs and knurled nuts; toggle clamps and the like.

Terms such as "left", "right", "up", "down", "bottom", "top", "front", "back", "in", "out" and the like are applicable to the embodiments shown and described in conjunction with the drawings. These terms may be used merely for the purpose of description and do not necessarily apply to the position in which the present invention may be utilized.

While a particular embodiment of the present invention has been shown and described, it is to be understood that the invention is not limited thereto and protection is sought to the broadest extent that the prior art allows.

What is claimed is:

1. A fixture for holding and aligning a blade of a hand tool to be sharpened by a sharpening apparatus, said fixture comprising:

a) a base member, said base member including a front side, a rear side, a clamping surface, a bottom surface, and a guiding means, said guiding means being selectively positioned and projecting from said bottom surface, said guiding means being positioned intermediate said front side and said rear side, said base member further including an aligning means projecting upwardly from a plane of said clamping surface, said aligning means being adapted for positioning a blade to be sharpened at a predetermined angle to an axis of said guiding means;

b) a clamping plate having a selected profile, said clamping plate being removably attached to said base member by at least two clamping means;

c) wherein said guiding means is configured for removable placement into a mating elongated groove that is formed into a tool rest plate of a sharpening apparatus, said removable placement selectively occurring at any position along a length of said elongated groove, said guiding means having a circular peripheral cross section that is selectively sized for simultaneously contacting at least two sides of said elongated groove for allowing a controlled pivotal movement of said base member about said axis of said guiding means during said placement into said elongated groove of said tool rest, said placement of said guiding means into said elongated groove also allowing selective controlled linear movement of said base member along a plane which is parallel to said axis of said guide means.

2. A fixture as recited in claim 1 wherein said guiding means includes and elongated circular rod which is carried in an elongated recess.

3. A fixture as recited in claim 2 wherein said elongated recess has at least one side wall being disposed at a predetermined angle with respect to said bottom surface.

4. A fixture as recited in claim 2 wherein said elongated recess has two side walls which are sloped toward each other at a predetermined angle with respect to said bottom surface.

5. A fixture as recited in claim 4 wherein said predetermined angle is sixty degrees.

6. A fixture as recited in claim 1 wherein said aligning means includes two pins having a predetermined length.

7. A fixture as recited in claim 6 wherein said two pins are hardened dowel pins.

8. A fixture as recited in claim 7 wherein the hardened dowel pins are of a stainless steel material.

9. A fixture as recited in claim 1 wherein said clamping surface is arrayed at a predetermined angle with respect to said bottom surface for allowing a tool with a short blade to be held and aligned thereon.

10. A fixture as recited in claim 9 which further includes a supporting plate assembly being adapted for attaching to a sharpening apparatus, said supporting plate assembly including a second elongated recess for guiding said guiding means therein, wherein said second elongated recess is substituted for said elongated groove of said tool rest.

11. A fixture as recited in claim 1 which further includes a supporting plate assembly being adapted for attaching to a sharpening apparatus, said supporting plate assembly including a second elongated recess for guiding said guiding means therein, wherein said second elongated recess is substituted for said elongated groove of said tool rest.

12. A fixture as recited in claim 10 wherein said second elongated recess includes at least one side being disposed at a predetermined angle with respect to a top surface of said supporting plate assembly.

13. A fixture as recited in claim 11 wherein said second elongated recess includes at least one side wall being disposed at a predetermined angle with respect to a top surface of said supporting plate assembly.

14. A fixture as recited in claim 2 wherein said elongated circular rod is made of a bearing material.

15. A fixture as recited in claim 14 wherein said bearing material is of a Ultra High Molecular Weight plastic.

16. A fixture as recited in claim 1 wherein said guiding means is formed integrally with said base member.

17. A fixture as recited in claim 1 which further includes a plastic sleeve covering and protecting said peripheral cross section.

18. A fixture as recited in claim 9 wherein said guiding means is formed integrally with said base member.

19. A fixture as recited in claim 18 which further includes a plastic sleeve covering and protecting said guiding means.

* * * * *